US005549515A

United States Patent [19]

Kondo

[11] Patent Number: 5,549,515

[45] Date of Patent: Aug. 27, 1996

[54] COIN-MAGIC DEVICE

[75] Inventor: Hiroshi Kondo, Tokyo, Japan

[73] Assignee: Tenyo Co., Ltd, Tokyo, Japan

[21] Appl. No.: 496,089

[22] Filed: Jun. 28, 1995

[30] Foreign Application Priority Data

Jul. 22, 1994 [JP] Japan ..... 6-171192

[51] Int. Cl.[6] ..... A63J 5/02

[52] U.S. Cl. ..... 472/71; 472/63; 446/13; 446/219

[58] Field of Search ..... 472/58, 63, 71, 472/72, 69; 40/427, 219, 900; 446/219, 10, 13

[56] References Cited

U.S. PATENT DOCUMENTS

| | | | |
|---|---|---|---|
| 787,535 | 5/1904 | McGrath | 472/71 |
| 1,052,277 | 2/1913 | Robinson | 472/71 |
| 2,199,818 | 5/1940 | Franke | 472/71 |
| 2,323,221 | 6/1943 | Hockey et al. | 446/13 X |
| 2,498,298 | 2/1950 | Renz | 472/71 |
| 3,822,879 | 7/1974 | Guitar | 472/72 |
| 4,288,072 | 9/1981 | Gewirtz | 472/69 |

*Primary Examiner*—Kien T. Nguyen

*Attorney, Agent, or Firm*—Sixby, Friedman, Leedom & Ferguson, P.C.; Gerald J. Ferguson, Jr.

[57] ABSTRACT

A coin-magic device has a stand on top of which a first coin receiving surface is formed. The device further comprises a tray that is used as placed on the first coin receiving surface to hide the coin. The tray has also a coin receiving surface that is referred to as a second coin receiving surface. Two more coins are placed on the second coin receiving surface. In addition, the device comprises a casing. When the casing is fitted onto the tray and stand, the tray is turned from the first coin receiving surface to the inner wall of the casing and appears as if it were the inner wall of the casing. Therefore, the two coins on the second coin receiving surface of the tray are hidden between the tray and the casing, and the coin on the first coin receiving surface will appear in stead. As the casing and tray are lowered along the stand while looking into the casing through a prism provided in an opening of a frame provided on top of the casing, the optical property of the prism will provide an illusion that the single coin on the first coin receiving surface look like two pieces. As the casing and tray are further lowered, the two coin images will approach each other and finally overlap each other. Thus, the audience will have an illusion that two coins have been halved to a single piece.

4 Claims, 8 Drawing Sheets

COIN-MAGIC DEVICE

The present invention relates to a coin-magic device that can be used to show two coins as if they were halved to a single piece.

SUMMARY OF THE INVENTION

The present invention has an object to provide a coin-magic device in which an optical effect of a special prism is utilized to show two coins as if they were halved to a single piece, thus providing a new amusement.

The present invention has another object to provide a simple-structure, easy-to-use coin-magic device.

The above object can be attained by providing a coin-magic device comprising, according to the present invention, a stand, a tray made of an opaque material and which is to be placed on the stand, a hollow casing open at both top and bottom thereof and made also of a same opaque material as that for the tray and which is to be fitted onto the stand and tray, a frame so mounted on the casing as to be openable and closable, and a prism fixed in the frame.

The stand has a rectangular top portion serving as a first coin receiving surface. The tray has a top surface nearly same in shape as the first coin receiving surface and which serves as a second coin receiving surface. The tray is to be set on the top of the stand to hide a coin placed on the first coin receiving surface. The tray is removable from the stand top.

The top and bottom openings of the hollow rectangular casing are generally same in shape as the second coin receiving surface. The frame has an opening nearly same in shape as the top opening of the casing. The frame is hinged to the casing at the top thereof. The prism is fixed in the opening of the frame. The prism has such an optical characteristic as will be described below. When the audience looks through the prism, the coin placed on the first coin receiving surface and staying in the proximity of the prism will appear as it is. However, the coin far from the prism looks like two pieces.

A small projection is formed on either end of the tray at the opposite corners thereof to turn the tray through an angle of substantially 90 degrees toward the inner wall of the casing when the casing is fitted onto, and lowered along, the stand, and also another projection is formed on the casing inner wall to retain the turned tray thereon.

When the casing is fitted a little on the tray mounted on the stand with the frame closed, the tray is instantly turned 90 degrees toward the inner wall of the casing and retained on the casing inner wall. When the interior of the casing is viewed from outside through the prism, a coin placed on the first coin receiving surface appears as two coin images on the second coin receiving surface. As the tray thus turned is lowered with the casing along the stand, the two images of the one coin will mutually approach to each other. When the frame is set nearly at the level of the first coin receiving surface, the two images will overlap each other to appear as one coin.

The coin-magic device according to the present invention can be an amusement having been described above. Also the device is simply constructed, comprising only a stand, tray, casing, frame and a prism.

For a coin magic with the device according to the present invention, the player places a coin nearly in the center of the first coin receiving surface of the stand. The player places and fits tray onto the first coin receiving surface of the stand to hide the coin placed on the first coin receiving surface. This is a preparatory procedure. Thereafter, the player places two coins as spaced from each other on the second coin receiving surface of the tray. The player fits the casing onto the tray and stand with the frame closed. While letting the audience look into the casing through the prism, the player lowers the casing little by little in relation to the stand. The audience will have an impression that the two coins have been halved to a single piece. Thus, the device according to the present invention is very easy to use.

How the foregoing and other more specific objects of the invention are achieved will appear in the ensuing more detailed description of an illustrative embodiment of the invention that will now be set forth in reference to the drawings.

DETAILED DESCRIPTION OF THE PREFERRED EMBODIMENTS

Figure 1:
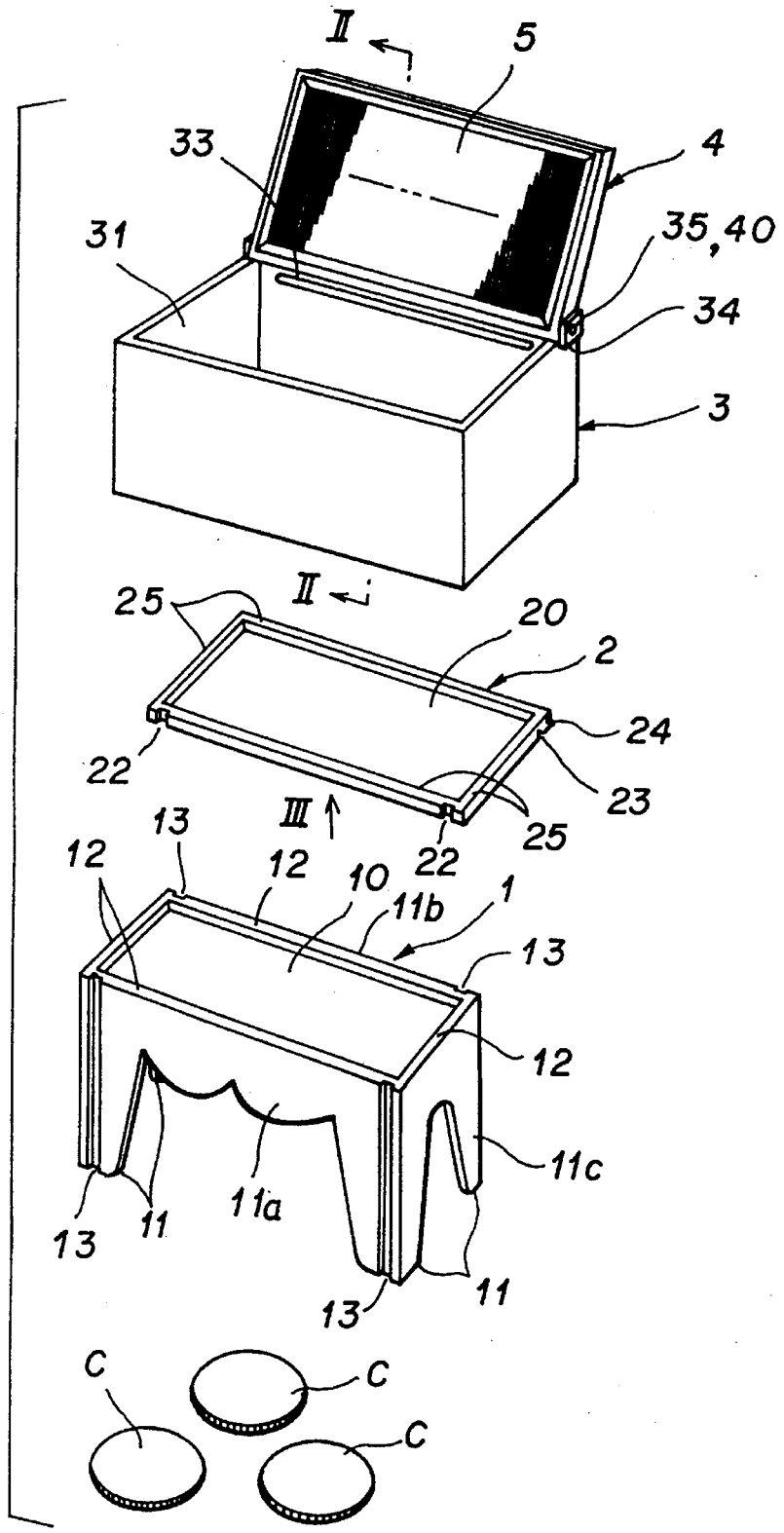
FIG. 1 is an exploded perspective view of one embodiment of the coin-magic device according to the present invention, showing coins, stand, tray, casing, frame and prism.

As shown in FIG. 1, three coins C of a same kind are used with the coin-magic device according to the present invention.

The major components of the coin-magic device according to the present invention include a stand 1, tray 2, casing 3, frame 4 and a prism 5.

The stand 1 comprises a fiat rectangular top portion 10 and four legs 11 extending nearly vertically downward from their respective corners. The stand 1 is made of an opaque synthetic resin, for example. The four legs 11 include a front one 11*a*, rear one 11*b* and lateral ones 11*c*. The top portion 10 serves as a first coin receiving surface on which one (will be referred to as "coin C.D" hereafter) of the three coins C is to be placed as will be described later. Further, the first coin receiving surface 10 has a projection 12 integrally formed circumferentially thereof and which have a generally same height as the thickness of the coin.

Figure 3:
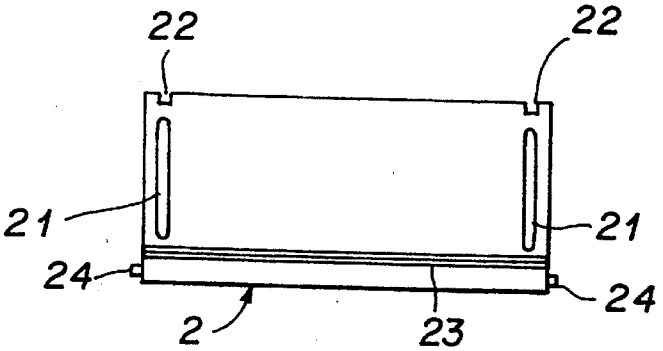
FIG. 3 is a view in the direction of arrow III in FIG. 1.
Figure 9:
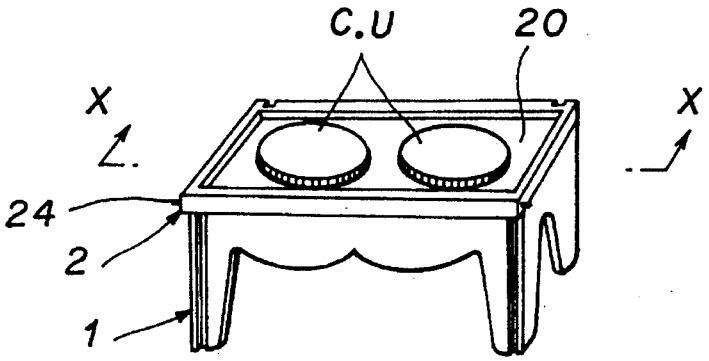
FIG. 9 is an explanatory drawing two coins placed on the second coin receiving surface of the tray placed on the first coin receiving surface.
Figure 10:
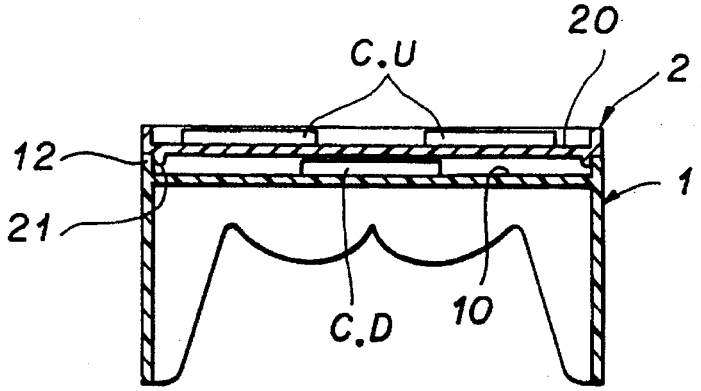
FIG. 10 is a sectional view taken along the line X—X in FIG. 9.
Figure 12:
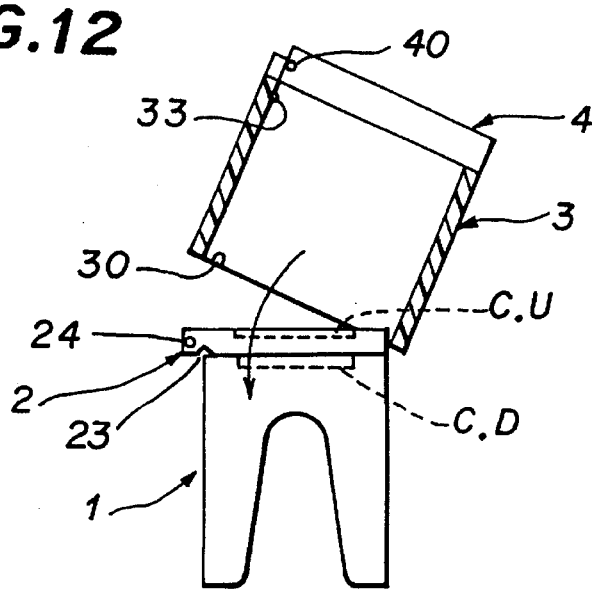
FIG. 12 is a partial sectional view showing the casing fitted on the stand and tray at the second opening thereof.

The tray 2 is a rectangular plate made of an opaque synthetic resin, for example. The tray 2 has a top surface 20 that serves as a second coin receiving surface on which two (will be referred to as "coins C.U" hereafter) of the three coins C are to be placed as will be described later. As shown in FIGS. 9 and 12, the tray 2 has a rectangular shape of which the long sides are equal in length to those of the first coin receiving surface 10 and the short sides are a little longer than those of the first coin receiving surface 10. It has a low vertical projection 25 integrally formed circumferentially thereof. This tray 2 is to be mounted on the projections 12 on the stand 1 to hide the coins C.D. As shown in FIGS. 3 and 10, the tray 2 has provided on the back thereof two elongated lands 21 that are directed along either short side thereof and serve to retain the tray 2 in place with respect to the stand 1. As shown in FIGS. 1, 3, 12 and 13, the tray 2 has further formed on the back thereof an elongated recess 23 that is directed in parallel to the longitudinal projection 12 on the stand 1 and is to be positioned on the outer circumference of one of the longitudinal projections 12 when the tray 2 is mounted on the top of the stand 1.

Further, two elongated recesses 13 are formed in the front and rear ones 11*a* and 11*b*, respectively, of the legs 11 of the stand 1. They extend vertically downward from near the four comers of the stand 1. The elongated recesses 13 correspond in position to the two elongated lands 21, respectively, formed on the rear side of the tray 2. As will be described later, the two recesses 13 receive the two lands 21, respectively, to guide the movement of the tray 2 when the casing 3 is fitted onto the stand 1 and tray 2.

Note that the one of the projections 25 of the tray 2, that extends along one long side thereof, has formed vertically therein two recesses 22 that are to be contiguous to the two guide recesses 13, respectively, formed in the front leg 11*a* or rear leg 11*b*, respectively, when the tray 2 is placed precisely on the tops of the protrusions 12 of the stand 1. Owing to these recesses 22, the tray 2 and the stand 1 will appear as if they were integral with each other.

Figure 2:
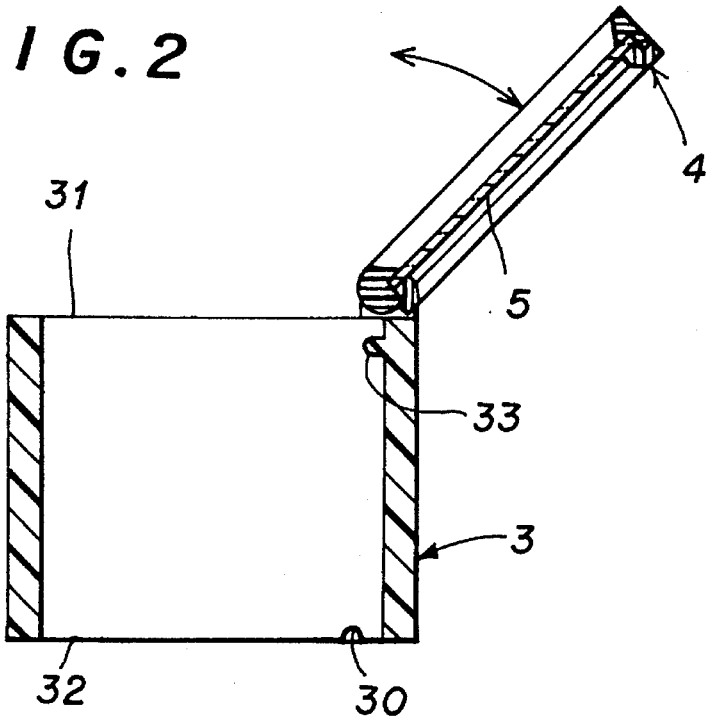
FIG. 2 is a sectional view taken along the line II—II in FIG. 1.

The casing 3 is hollow and a little lower than the legs 11 of the stand 1. It is made of an opaque material, for instance. As shown in FIG. 2, the casing 3 is open at the top and bottom thereof as indicated at 31 and 32, respectively. The openings 31 and 32 are slightly larger than the tray 2 and are rectangular in shape. The casing 3 has such a shape and dimensions as to be fittable on the stand 1 and tray 2. When the casing 3 is fitted onto the stand 1 and tray 2, the tray 2 can be turned 90 degrees in relation to the stand 1 and then smoothly moved down as guided along the two recesses 13 formed in the rear leg 11*b* of the stand 1 as will be described later.

Figure 14:
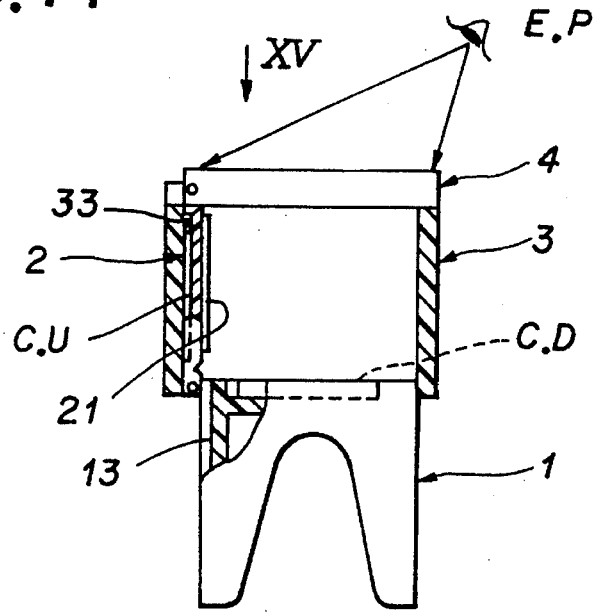
FIG. 14 is a partial sectional view showing the tray retained on the inner wall of the casing and looking like the inner wall itself, the two coins on the second coin receiving surface of the tray being hidden between the casing and tray and the coin on the first coin receiving surface of the stand being visible from above.

The tray 2 is turned in relation to the stand 1 by means of an elongated recess 23 formed in the back of the tray 2, a pair of small projections 24 formed near the recess 23 and extending horizontally from two opposite corners of the tray 2, and a pair of concavities 30 formed in the end face of the bottom opening 32 of the casing 3 correspondingly to the two projections 24. By lowering the casing 3 a little as fitted at the two recesses 30 thereof onto the two projections 24 of the tray 2 in order to fit the casing 3 onto the stand 1 and tray 2, the tray 2 is instantly turned 90 degrees with one of the projections 12 of the stand 1 engaged in the recess 23 (this position will be referred to as "first position" hereafter). As shown in FIGS. 1 and 14, the casing 3 has an elongated projection 33 formed horizontally on the inner wall thereof near the top opening 31. The tray 2 turned 90 degrees is held closely on the casing 3 with the projection 25 engaged on the projection 33.

When the casing 3 is further lowered, the elongated lands 21 formed on the back of the tray 2 are slid as guided in the recesses 13 formed in the legs 11 of the stand 1 with the tray 2 closely held on the inner wall of the casing 3, and the end of the top opening 31 of the casing 3 is slid until the top opening 31 of the casing 3 reaches the top of the projections 12 of the stand 1 (this position will be referred to as "second position" hereafter).

The frame 4 has an opening generally identical in shape to the top opening 31 of the casing 3. The frame 4 is mounted on the casing 3 openably and closably with respect to the top of the casing 3. The frame 4 is provided with a shaft 40 extending horizontally. The shaft 40 is born at either end thereof in a small circular through-hole 35 formed in each of fixtures 34 provided near the top opening 31 of the casing 3. The frame 4 is made of an opaque synthetic resin, for example. Furthermore, the frame 4 has provided in the opening thereof the prism 5 having the optical properties as will be described. The prism 5 is a soft sheet.

Figure 4:
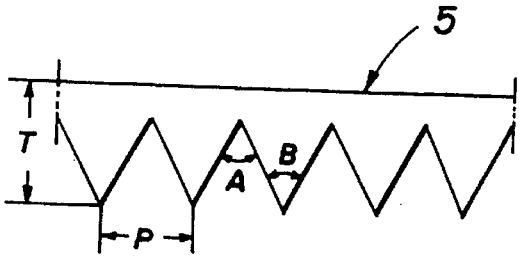
FIG. 4 is a plan view, partially enlarged in scale, of the prism.
Figure 5:
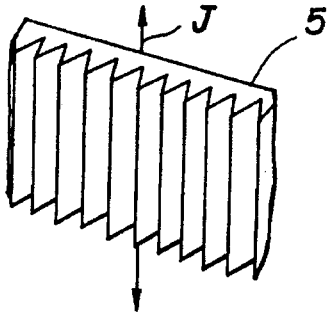
FIG. 5 is a perspective view, partially enlarged in scale, of the prism.

As shown in FIGS. 4 and 5, the prism sheet 5 has formed on one side thereof a plurality of triangular prism elements parallel to each other. The other side of the prism 5 is a fiat surface. The angle A of each valley between the triangular prism elements and angle B of the each peak are approximately 63 degrees, the pitch P between the triangular prism elements is approximately 0.38 mm and the prism sheet thickness T is approximately 0.35 mm. When the frame 4 is closed to the top of the casing 3, the fiat side of the prism sheet 5 forms the inner side of the frame 4 while the triangular prism element side forms the outer side of the frame 4. The direction J of the triangular prism element ridges coincides with the directions of the short sides of the first coin receiving surface 10, second coin receiving surface 20, top opening 31 and bottom opening 32.

Figure 15:
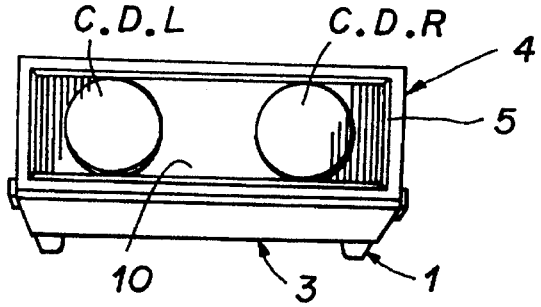
FIG. 15 is a view from arrow XV in FIG. 14.
Figure 16:
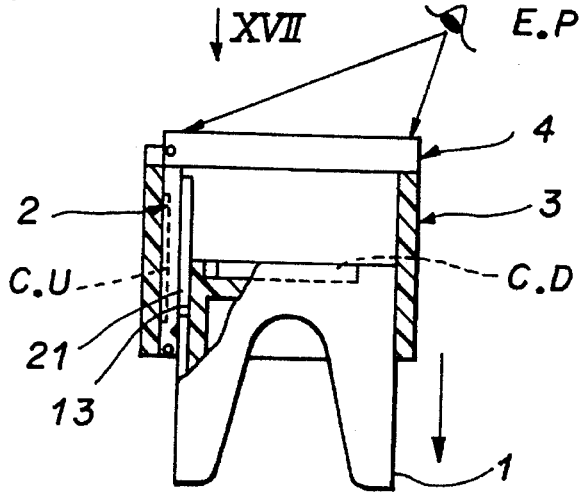
FIG. 16 is a partial sectional view showing that the casing and the tray looking like the inner wall of the casing are lowered little by little along the stand.
Figure 17:
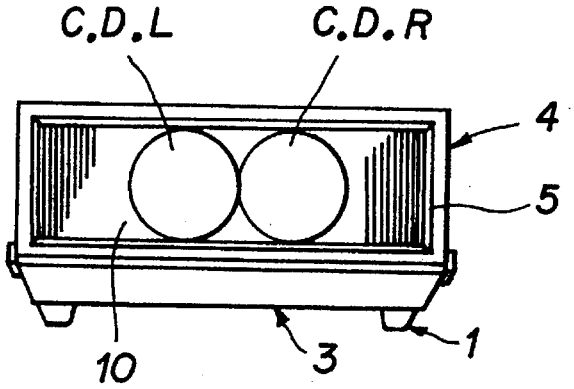
FIG. 17 is a view from arrow XVII in FIG. 16.
Figure 18:
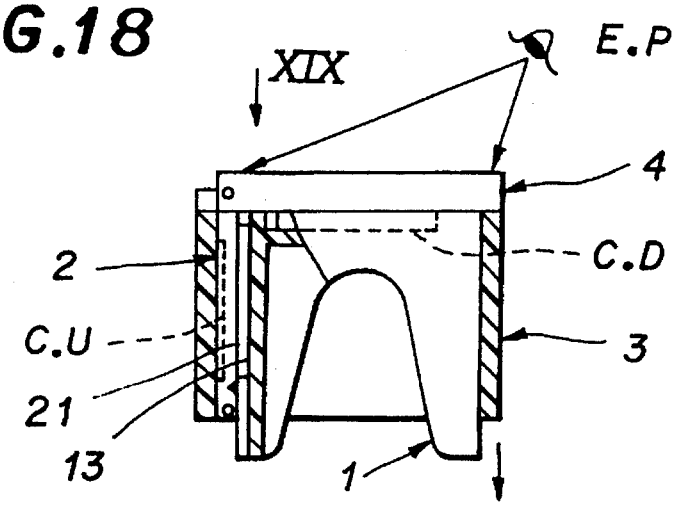
FIG. 18 is a partial sectional view showing the frame being held as placed on a projection formed on the top of the stand.
Figure 19:
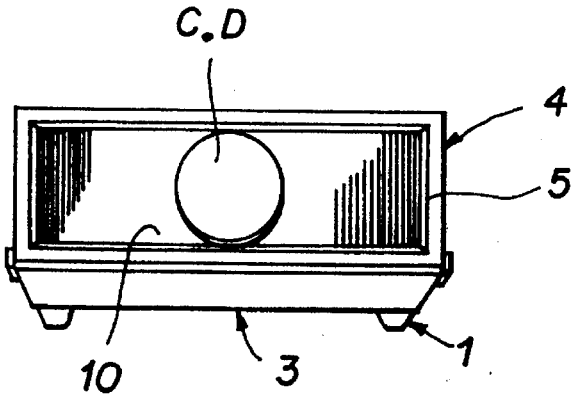
FIG. 19 is a view from arrow XIX in FIG. 18.

As seen from FIGS. 14 and 15, when the casing 3 is placed in the first position with the frame 4 closed, a coin C.D placed on the first coin receiving surface 10 appears as if it were doubled to two coins C.D.L and C.D.R positioned to the right and left, respectively, of the real position thereof. Namely, the coin C.D appears like two coins C.U placed on the second coin receiving surface 20. As the casing 3 is slid downward from the first to second position, it seems that the two coin images C.D.L and C.D.R gradually approach each other and finally overlap partially each other (as shown in FIGS. 16 and 17). Further, when the casing 3 is in the second position, the two coin images C.D.L and C.D.R appear overlapping fully each other, namely, they look like a single coin C.D (as shown in FIGS. 18 and 19).

Figure 6:
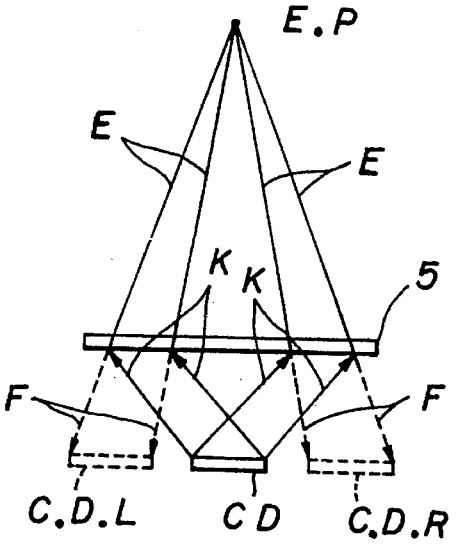
FIG. 6 is an explanatory drawing showing the principle of the present invention that a single coin placed on the first coin receiving surface of the stand appears as doubled, namely, it looks as two coins, shifted to the right and left, on the second coin receiving surface of the tray.
Figure 7:
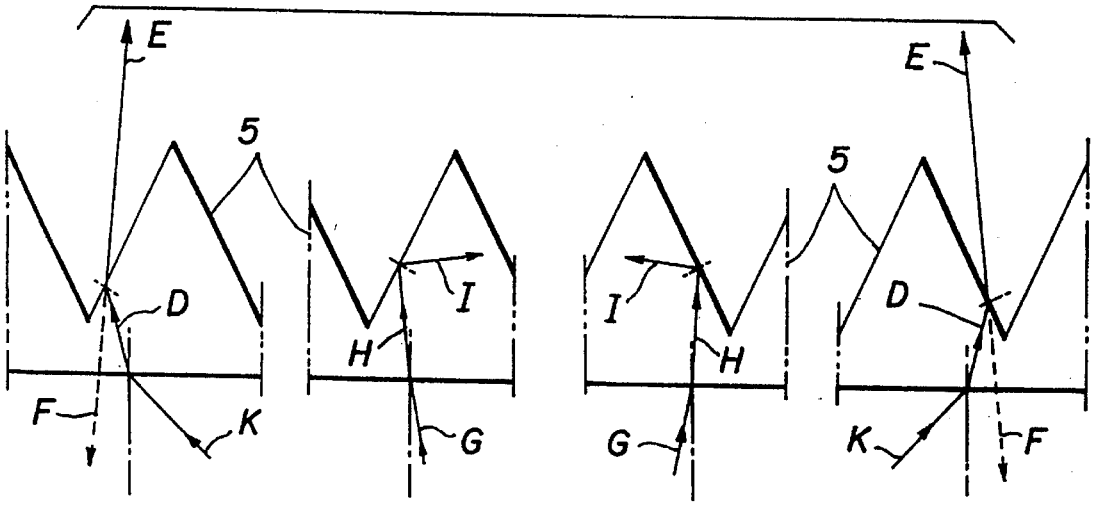
FIG. 7 is a view, partially enlarged in scale, of the prism in FIG. 6.

The optical property of the prism 5 will be briefly described below. When a coin is placed very near the prism, the coin will be visible as it is through the prism. As the distance of the coin from the prism is longer, the coin will look like two pieces. This will be described with reference to FIGS. 6 and 7. The light K reflected by the coin C.D is refracted at the right and left inner wall (lower) portions of the prism 5. The refracted light D is further refracted at the triangular prism elements on the outer surface of the prism 5. The reflected light E goes outwardly from both the right and left sides of the prism 5 and is incident upon the eye E.P. Thus, when the coin C.D on the first coin receiving surface 10 inside the casing 3 is viewed through the prism 5 located a little away from the first coin receiving surface 10, the images C.D.L and C.D.R of the coin C.D placed on the first coin receiving surface 10 look as if they are shifted to the left and right, respectively, on an extension line F of the refracted light E incident upon the eye E.P through the prism 5.

Nearly at the center of the prism 5, the light G from the coin C.D is refracted at the fiat surface inside (lower side) the prism 5, the refracted light H is reflected at the triangular prism element surface outside (upper side) nearly the central portion of the prism 5, and the reflected light I goes out of the prism 5. Thus, the images C.D.L and C.D.R of the coin C.D placed on the first coin receiving surface 10 appear as if they were shifted to the left to the right through the left and right portions, respectively, of the prism 5.

Figure 8:
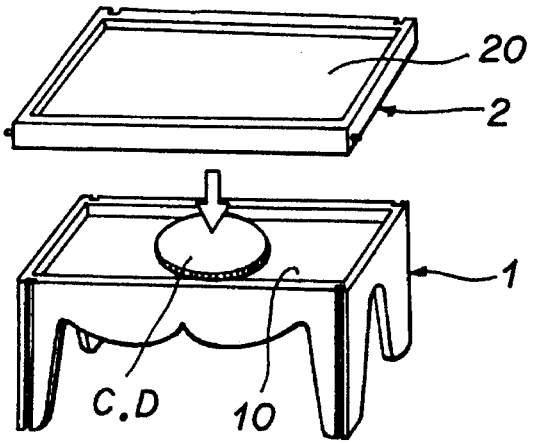
FIG. 8 is an explanatory drawing showing a coin place on the first coin receiving surface of the stand and the tray going to be placed on the first coin receiving surface.

The coin-magic device according to the present invention is constructed as having been described in the foregoing. For a magic play, the device is to be used as in the following:

Preparation:

First, the player places a coin C.D nearly in the middle of the first coin receiving surface 10 of the stand 1, and then the tray 2 on the top of the stand 1 (as shown in FIG. 8). At this time, the coin C.D on the first coin receiving surface 10 is not visible because it is hidden under the tray 2 (as shown in FIGS. 9 and 10). Also, the stand 1 and tray 2 appear as if they were integral with each other (as shown in FIG. 9). Further, the player turns the stand 1 at the front leg 11*a* thereof toward himself or herself (as shown in FIG. 9). Here the preparation is over.

Magic playing:

First, the player places two coins C.U on the second coin receiving surface 20 of the tray 2 as a little separated to the right and left from the center of the tray 2 (as shown in FIGS. 9 and 10). At this time, the three coins C (including the one C.D and two C.Us) should be laid with the same side up and in a generally same direction.

Figure 11:
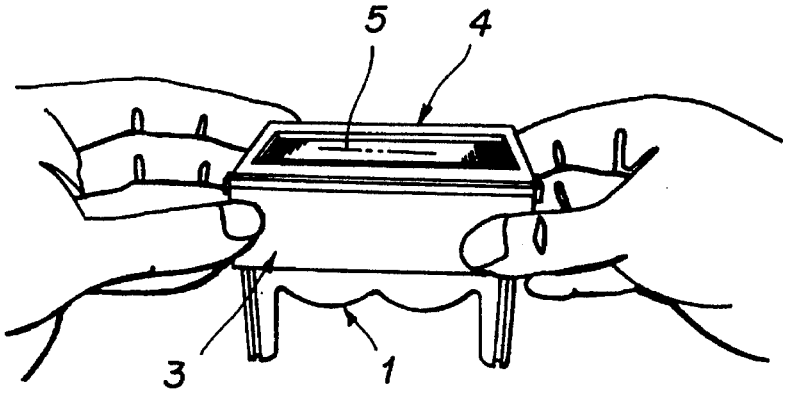
FIG. 11 is a perspective view showing the casing fitted on the stand and tray at the second opening thereof.

Next, the player puts the casing 3 at the bottom opening 32 thereof onto the assembly of the stand i and the tray 2 mounted on the projections 12 of the stand 1 (as shown in FIG. 11).

Figure 13:
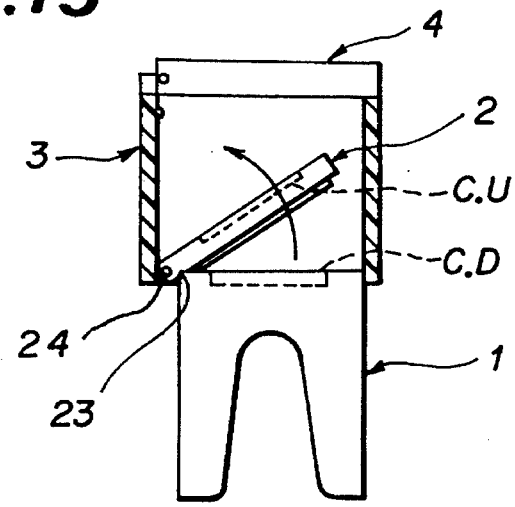
FIG. 13 is a partial sectional view showing the tray being turned toward the inner wall of the casing from the first coin receiving surface when the casing is fitted on the stand and tray at the second opening thereof.

Then, the player applies the inner wall of the bottom opening end of the casing 3 onto the outer circumference of the projection 25 on the tray 2, and the turns the casing 3 about the outer circumference in the direction arrow as shown in FIG. 12. The player fits the casing 3 onto the stand 1 with the two recesses 30 formed in the casing 3 set on two small horizontal projections 24 at the opposite ends of the tray 2. By lowering the casing 3 along the stand 1, the tray 2 is turned about the horizontal projections 24 thereof from the first coin receiving surface 10 of the stand 1 in the direction of arrow toward the inner wall of the casing 3 (as shown in FIG. 13). When the inner walls of the projections 25 of the tray 2 engage on the projection 33 on the casing 3, the tray 2 is held closely on the inner wall of the casing 3 and also it appears like the inner wall of the casing 3. The two coins C.U on the second coin receiving surface 20 of the tray 2 are hidden between the inner wall of the casing 3 and the tray 2, and thus the coin C.D on the first coin receiving surface 10 appears (as shown in FIG. 14).

The player lets the audience look the coin C.D on the first coin receiving surface 10 inside the casing 3 through the prism 5. Because of the principle of the prism 5 having been described in the foregoing, the two images C.D.L and C.D.R of the coin C.D on the first coin receiving surface 10 seem as shifted to the right and left to give an illusion that the two coins C.U placed on the second coin receiving surface 20 of the tray exist there (as shown in 15).

While letting the audience looking into the casing 3 through the prism 5, the player lowers slowly the casing 3 together with the tray 2 held closely on the inner wall of the casing 3 along the stand 1 in the direction of arrow in FIG. 16. The two images C.D.L and C.D.R of the coin C.D on the first coin receiving surface 10 approach each other (as shown in FIG. 17) and overlap partially on each other.

Thereafter, the player slides down the casing 3 until the frame 4 touches the upper end of the projection 12 on the stand 1 (as shown in FIG. 18). The two images C.D.L and C.D.R of the coin C.D on the first coin receiving surface 10 overlap entirely each other and look like a single coin (as shown in FIG. 19).

Figure 20:
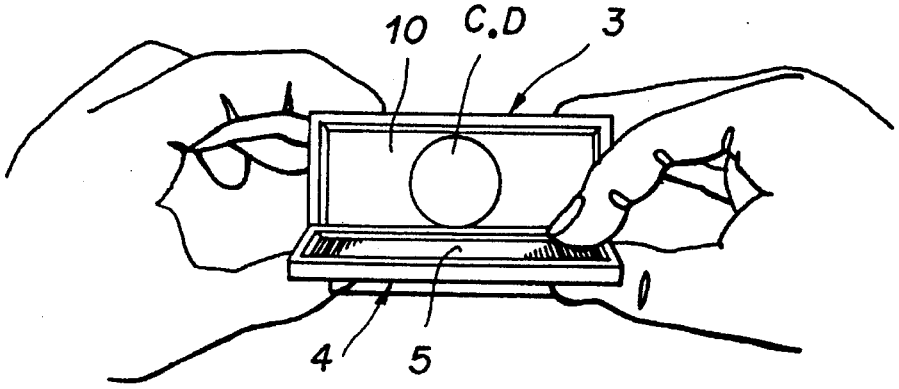
FIG. 20 is an explanatory drawing showing one coin placed on the first coin receiving surface of the stand with the frame opened.

At this time, the player opens the frame 4 (as shown in FIG. 20). The coin C.D is seen on the first coin receiving surface 10, and the audience will have an illusion that the two coins C.U having been placed on the second coin receiving surface 20 of the tray 2 were halved to a single piece.

Figure 21:
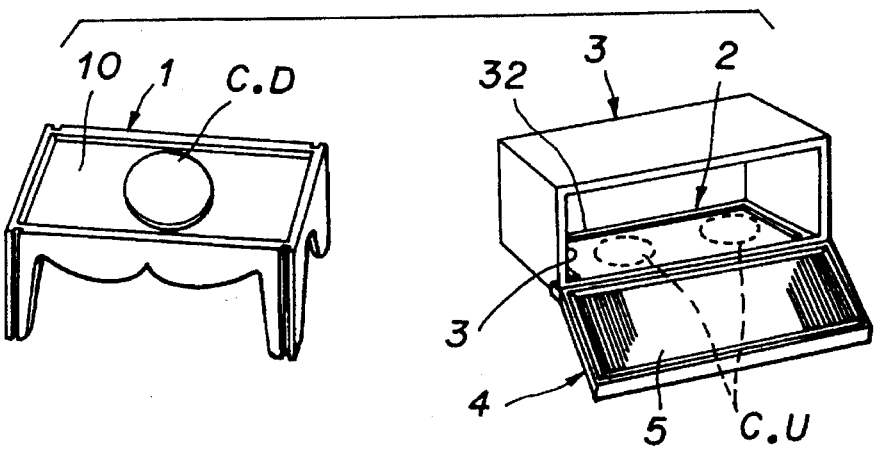
FIG. 21 is an explanatory drawing showing the casing and the tray looking like the inner wall of the casing, both removed from the stand, which is displayed to the audience for appealing "there is no deception"

Actually, the two coins C.U on the second coin receiving surface 20 of the tray 2 are hidden between the casing 3 and tray 2 (as shown in FIG. 21) and the two images C.D.L and C.D.R of the coin C.D on the first coin receiving surface 10 of the stand 1 look just like two coins C.U initially placed on the second coin receiving surface 20.

Then, the player removes from the stand 1 the casing 3 and tray 2 camouflaged as the inner wall of the casing 3 to appeal that there is no deception (as shown in FIG. 21).

Figure 22:
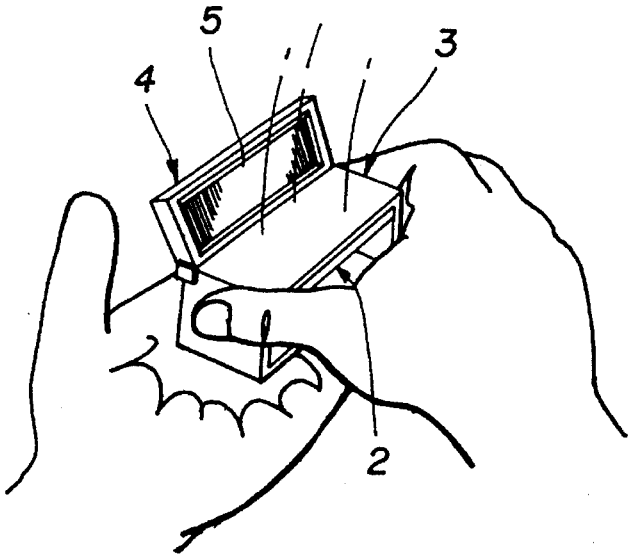
FIG. 22 is an explanatory drawing showing the tray being removed from on the inner wall of the casing.

For reusing the device once used, the player hits the casing 3 to detach the tray 2 retained on the inner wall of the casing 3 before making any preparation for a magic with coins (as shown in FIG. 22).

As having been described in the foregoing, the coin-magic device according to the present invention utilizes the prism 5 having the above-mentioned special optical property and can be used to provide an illusion that two coins are halved to a single piece.

The coin-magic device according to the present invention is simply constructed, comprising only the stand 1, tray 2, casing 3, frame 4 and the prism 5. Also the coin-magic device is very easy to use as having previously been described.

What is claimed is:

1. A coin-magic device, comprising:

a stand having a first rectangular surface on which a coin is to be received generally in the center thereof;

a tray made of an opaque material, same in shape as the first coin receiving surface of said stand, having a second surface on which two coins are to be received as spaced from each other, and which is removably mounted on said stand to hide said one coin on the first coin receiving surface;

a hollow rectangular casing made of an opaque material, having openings at both top and bottom thereof, said openings being generally identical in shape to the second coin receiving surface, and which is to be fitted onto said stand and tray;

a frame having an opening generally identical in shape to the top opening of said casing and which is mounted to said casing openably and closably with respect to the top of said casing;

a prism fixed to said frame to cover the opening in said frame and having such an optical property that when the coin on said first coin receiving surface is near said prism, it will appear as it is through said prism and that as the coin is farther from said prism, the coin will look as if it were double to two pieces; and a means provided between said tray and casing to turn the second coin receiving surface of said tray through an angle of substantially 90 degrees toward the inner wall of said casing and a means of retaining said tray thus turned on the inner wall of said casing.

2. A coin-magic device as set forth in claim 1, wherein said tray has formed thereon projections which block said tray from being displaced horizontally in relation to said stand.

3. A coin-magic device as set forth in claim 1, wherein said stand has formed therein guide recesses along which said tray is slid along with said casing in relation to said stand.

4. A coin-magic device as set forth in claim 1, wherein said means of turning said tray comprises an elongated recess formed longitudinally in the back of said tray, two small projections formed as extended longitudinally and horizontally from opposite corner end of said tray, and two concavities formed in opposite end portions of the bottom opening of said casing correspondingly to said projections.

* * * * *